US005133545A

United States Patent [19]

Moschetti et al.

[11] Patent Number: 5,133,545

[45] Date of Patent: Jul. 28, 1992

[54] PROGRESSIVE ACCOMMODATING RESISTANCE EXERCISE DEVICE

[76] Inventors: Mitchell R. Moschetti, P.O. Box 10834, Denver, Colo. 80498; Jeffrey J. Smith, 3353 Monaco St., Denver, Colo. 80237; William Hollander, 5012 Valhalla Dr., Boulder, Colo. 80301

[21] Appl. No.: 770,763

[22] Filed: Oct. 2, 1991

Related U.S. Application Data

[63] Continuation of Ser. No. 544,247, Jun. 26, 1990, abandoned.

[51] Int. Cl.[5] ..... A63B 21/22

[52] U.S. Cl. ..... 482/115; 482/110; 482/903

[58] Field of Search ..... 272/71, 128, 129, 132, 272/DIG. 5

[56] References Cited

U.S. PATENT DOCUMENTS

| | | | |
|---|---|---|---|
| 1,416,741 | 5/1922 | Nicholls et al. . | |
| 1,868,262 | 7/1932 | Staley . | |
| 1,869,673 | 8/1932 | Duff . | |
| 1,909,461 | 5/1933 | Costa . | |
| 2,512,911 | 6/1950 | Benice . | |
| 2,857,162 | 10/1958 | Zuercher . | |
| 2,921,791 | 1/1960 | Berne . | |
| 3,465,592 | 9/1969 | Perrine . | |
| 3,640,530 | 2/1972 | Henson et al. . | |
| 4,041,760 | 8/1977 | Henson et al. | 272/128 |
| 4,537,396 | 8/1985 | Hooper | 272/71 |
| 4,678,184 | 7/1987 | Neiger et al. | 272/132 |

*Primary Examiner*—Richard J. Apley
*Assistant Examiner*—Lynne Reichard

[57] ABSTRACT

The present invention relates to a progressive accommodating resistance exercise device including a retractable cable, resistance means for providing a resistance force opposing extension of the cable such that the resistance force is a function of the speed of cable extension for all resistance forces having a magnitude greater than the fixed cable retraction force, and adjustment means for varying the relationship between the resistance force and the speed of cable extension for all resistance forces greater in magnitude that the fixed cable retraction force. Means are also disclosed for minimizing the likelihood of joint hyperextension during use.

20 Claims, 11 Drawing Sheets

PROGRESSIVE ACCOMMODATING RESISTANCE EXERCISE DEVICE

BACKGROUND OF THE INVENTION

1. Field of the invention

The present invention relates to an exercise device, and more particularly, to a progressive accommodative resistance exercise device designed to provide resistance which varies as a function of the speed at which with which the exercise is performed.

2. Description of the Prior Art

Conventional exercise methods suffer from a variety of disadvantages. For example, free weights suffer from the limitation that the same weight must be used through the entire range of motion of the exercise device. This is usually less than ideal in that the strength of the exercise muscles may vary considerably over the range of motion of the exercise. The amount of the weights used is therefore often determined by the maximum safe load that can be used through the portion of the range of the motion where the muscles are weakest. This selected weight is often inadequate to fully exercise the muscles through the portion of the range of motion where they are strongest. Free weights are also disadvantageous for exercises performed at high speeds because they develop their own inertia and fail to provide adequate resistance.

Alternate devices have been developed that provide variable resistance over the range of exercise motion. These devices also suffer from disadvantages related to those of free weights. For example, surgical tubing, spring, and other related elastic/pneumatic/hydraulic based exercise devices offer resistance that varies according to the distance that the device is compressed and/or expanded. These devices are disadvantageous in that this linearly variable resistance usually does not vary to match the user's muscular capacity throughout the entire range of motion, except in specific instances in which muscular capacity varies directly with the distance travelled. Similarly, cam based weights are known which provide variable resistance over a range of motion. These types of devices are disadvantageous in that the eccentric radii and curvature of the cams are not adjustable to precisely accommodate for the varying limb/lever length of individual users. Such devices are also disadvantageous because the user's body may develop inertia when the exercise is performed at high speed, reducing exercise's effectiveness.

As a result of the disadvantages identified above, exercise makers have sought to develop exercise devices that provide resistance which varies according to the force exerted by the user through a complete range of motion. Such devices are commonly referred to as progressive accommodating resistance exercise devices. An example of such a device is described in U.S. Pat. No. 3,640,530 to Henson, et al. Henson, et al describes a multi-disc clutch type of arrangement whereby the resistance provided to the pulling of rope varies according to the force applied to the rope. The device is disadvantageous, however, because the relationship between the resistance and the force exerted cannot be varied to suit the needs of the user.

Another disadvantage of conventional exercise devices is that they do not provide means to reduce the likelihood of joint hyperextension. Joint hyperextension is a common injury associated with resistance exercise devices. Joint hyperextension typically occurs as inertia carries the weights or force bearing load past the point of full joint extension. This initial hyperextension can then be aggravated when the inertia drops off and the resistance load is suddenly applied to the already hyperextended joint. Although joint hyperextension is typically associated with free weights, cam based free weights and elastic/pneumatic resistance devices, such injury can also occur with known isokinetic resistance exercise devices.

SUMMARY OF THE INVENTION

The present invention relates to a progressive accommodating resistance exercise device including a retractable cable, resistance means for providing a resistance force opposing extension of the cable such that the resistance force is a function of the speed of cable extension for all resistance forces having a magnitude greater than the fixed cable retraction force, and adjustment means for varying the relationship between the resistance force and the speed of cable extension for all resistance forces greater in magnitude than the fixed cable retraction force.

The invention is advantageous over conventional devices for a number of reasons. For example, the resistant force is reduced to the negligible cable retraction force when the user ceases movement, such as when extension is complete or stopped because of fatigue. "Spotters" are therefore not required, and the likelihood of injury is extremely reduced. The resistance means for providing a resistance force opposing extension of the cable such that the resistance force is a function of the speed of cable enables exercise to be performed at high speed without the disadvantages associated with inertia of the free weights. Moreover, the adjustment means for varying the relationship between the resistance force and the speed of cable extension enables the device to be adjusted to suit the needs of individual users. These and other advantages will become apparent to the reader upon review of the description set forth below.

BRIEF DESCRIPTION OF THE DRAWINGS

In the description which follows, an illustrative embodiment of the present invention is explained in great detail with the aid of drawings in which.

DETAILED DESCRIPTION OF THE PREFERRED EMBODIMENT

For the purposes of illustration only, the present invention is described in terms of its preferred physical embodiment. It will be apparent to those skilled in the art that the present invention is not limited in scope to the preferred physical embodiment, but rather is adaptable to numerous other embodiments. Similarly, various modifications and improvements may be made to the present invention as it relates to the preferred physical embodiment and other alternate embodiments without departing from the scope and spirit of the invention. Accordingly, the present invention is limited only by the scope of the appended claims.

The exercise device of the present invention relates to a progressive accommodating resistance device in which a resistance mechanism provides a resistance force to a cable such that the resistance varies as a function of the speed at which the cable is extended. The invention also includes a mechanism to allow variation in the relationship between the speed of cable extension and the resistance force to suit the needs of the individual user.

The present invention is adaptable to a vast number of exercise applications in which a cable may be used to provide a resistant force. For the purpose of illustration only, the present invention will hereinafter be described with respect to its best mode, an exercise device for the legs. It should be well understood, however, that the present invention is not limited to this specific application or embodiment.

Figure 1:
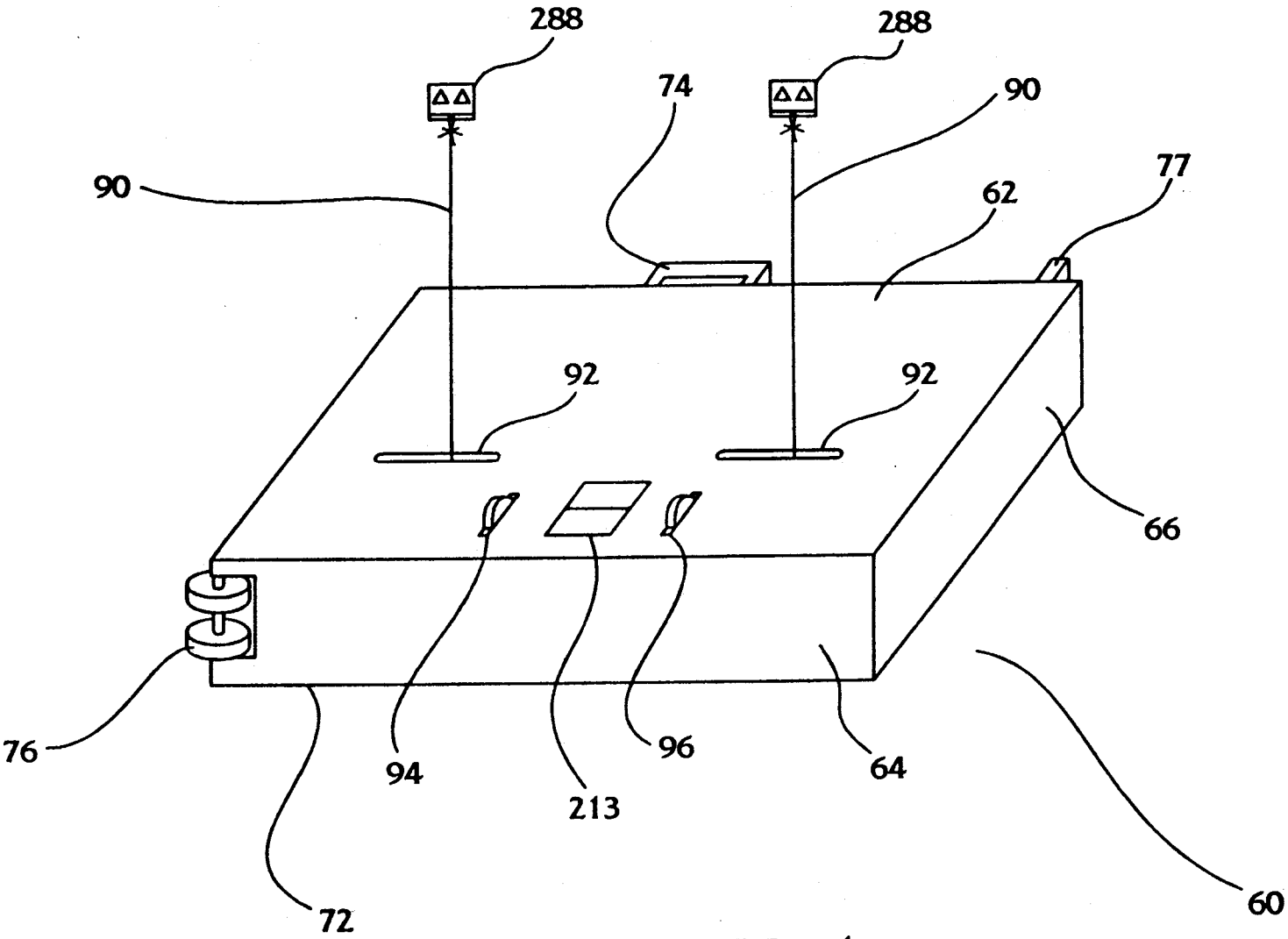
FIG. 1 is a top perspective view of one embodiment of the present invention.

The best mode of the present invention is best understood with reference to FIG. 1. The invention includes a three dimensional rectangular housing 60, with a top panel 62, a front panel 64, a side panel 66, an opposite side panel 68, a back panel 70 and bottom panel 72. The housing is preferably portable and compact, comparable in size to a suitcase so it may be handled as such, and may include a carrying handle 74 on its back panel 70 (see also FIG. 3). At least one wheel 76 may also be provided along one corner of the front panel 64 to allow for rolling transport when used in conjunction with the second handle 77 located at the opposite corner of the back panel.

The housing 60 should be constructed of materials having characteristics sufficient to allow a user to perform jumping types of exercises on its top panel 62, but at the same time minimizing weight so that the invention may remain portable. As an example, the housing may include a series of interconnected frame members 79 made of aluminum tubing (see FIG. 3), as well as the top 62 and bottom 72 panel members being constructed of aluminum sheeting and being mounted about the frame members 79 by any conventional manner. Depending upon the arrangement of the frame members 79 and the top 62 and bottom 72 panels, all of the other panels, including the side, front and back panels, may be designed not to support any considerable loads during use. They may therefore be constructed of materials selected for their cosmetic and weight characteristics alone. As an example, the side, back and front panels may be constructed of ABS plastic.

Figure 2:
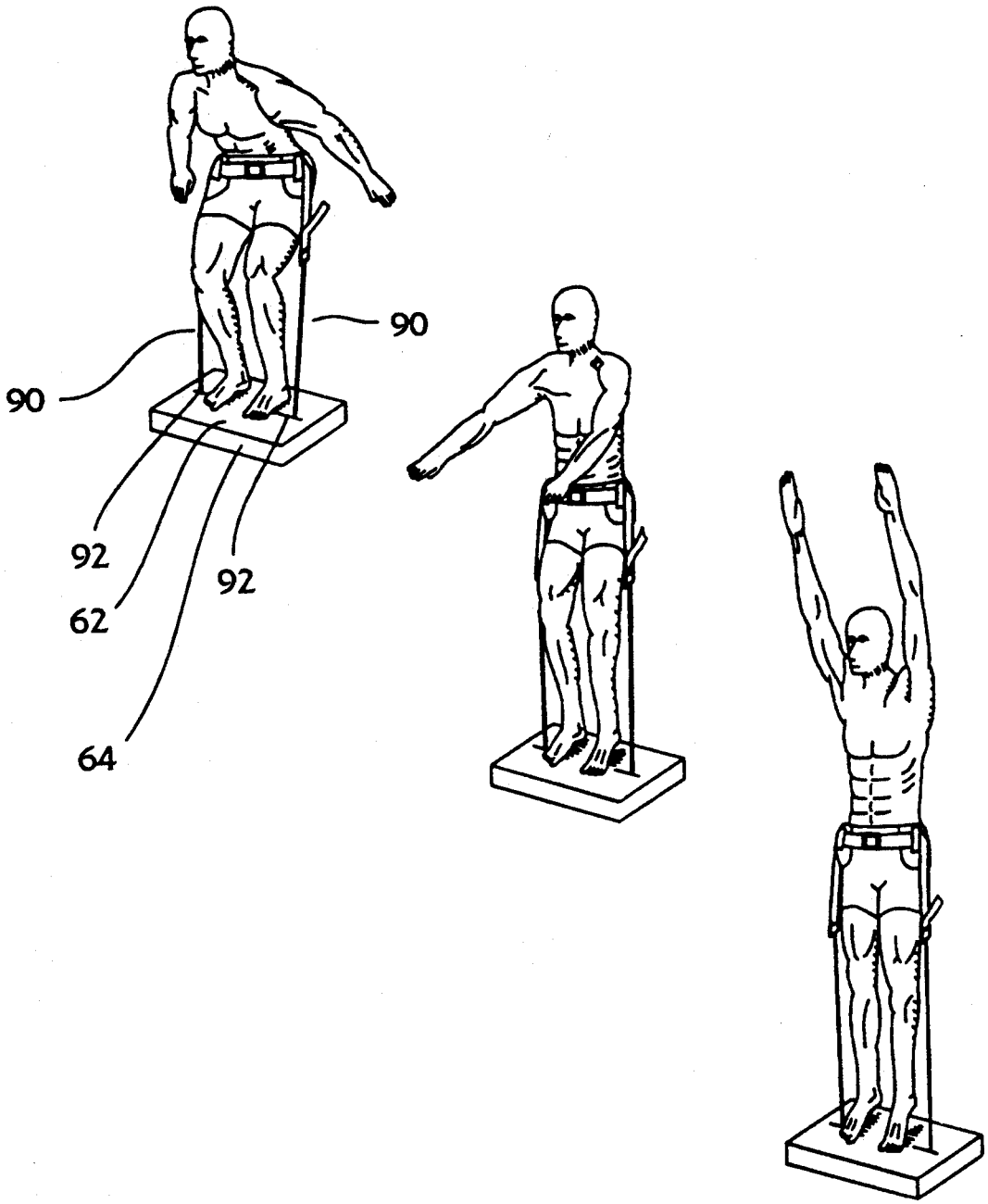
FIG. 2 is a successive three image view of a person using one embodiment of the present invention.

As illustrated in FIGS. 1 and 2, the present invention includes two cables 90 extending through slots 92 located in the top panel 62. In operation, the user stands on the top panel 62 facing the front panel 64 and secures the two cables 90 about a belt apparatus secured about the user's hips. Exercise is attained by extension of the lower extremities after squatting, including the hips, knees and ankles. Control wheels 94 and 96 (which will be described in more detail later) also preferably extend partially above the top panel 62 in the vicinity of the user's feet to allow the user to control various functions of the invention without having to leave the top panel 62.

Figure 3:
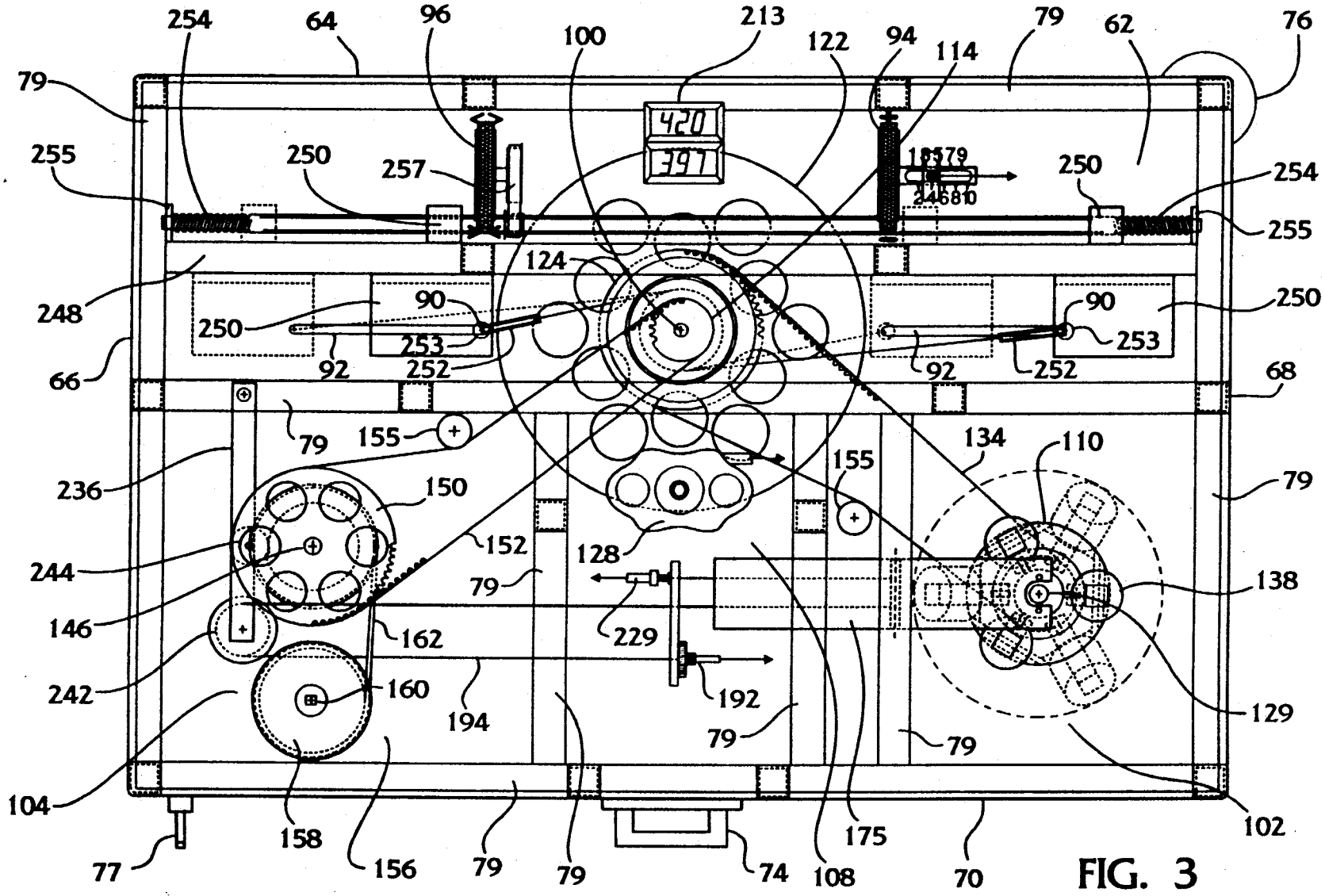
FIG. 3 is a top view of selected components of one embodiment of the present invention.

FIG. 3 illustrates a view of the present invention in which the top panel has been removed to expose various frame members 79, three primary areas 100, 102 and 104 of the exercise device, and three correspondingly associated rotating shafts. A first area 100 includes the primary shaft 106 about which the cables 90 are wound. The primary shaft 106 also includes a braking mechanism 108 to provide resistance to the extension of the cables 90. The second area 102 includes a governor 110 which produces an output to the braking mechanism 108 which varies according to the speed of cable extension. The third area 104 is a cable recoil area which provides the requisite force for recoiling the cables 90 upon the primary shaft 106 after extension by the user.

Figure 4:
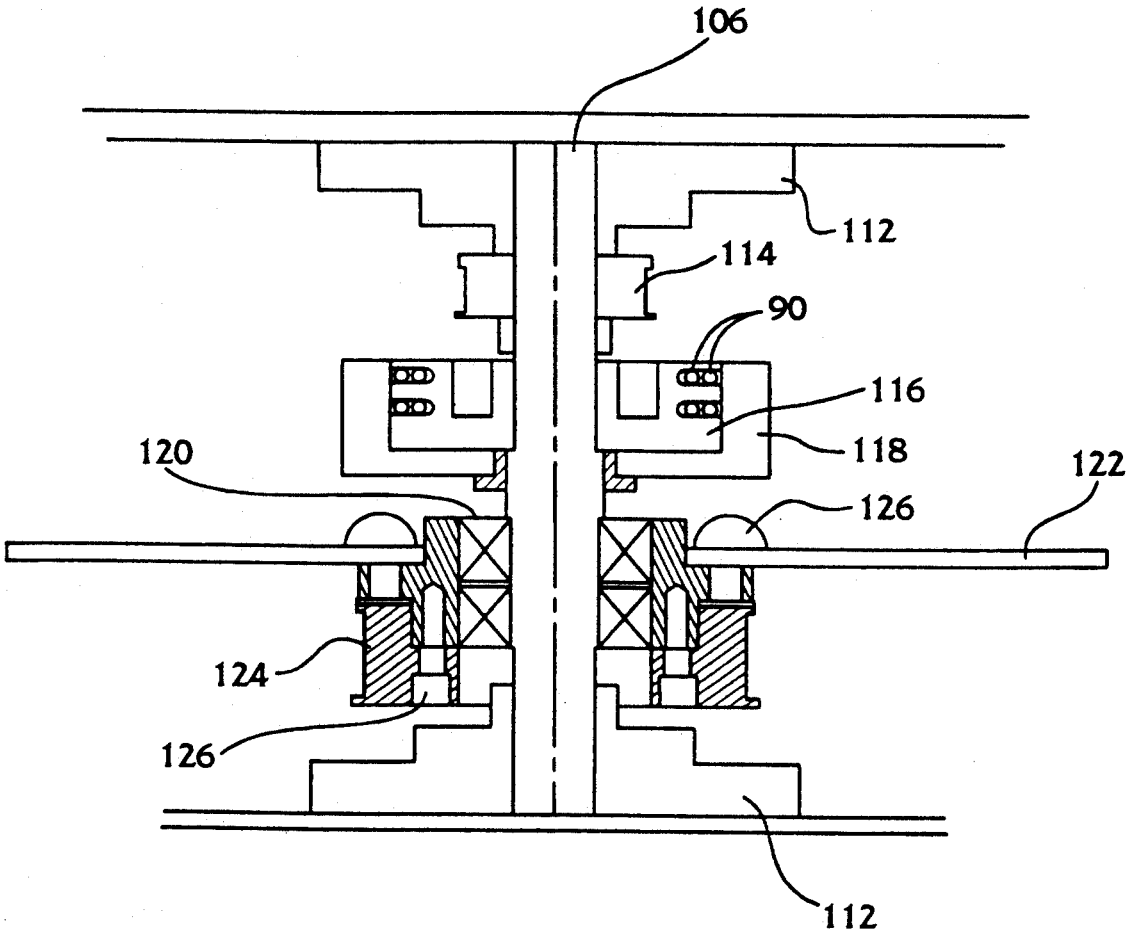
FIG. 4 is a side view of the primary shaft of one embodiment of the present invention.

Taking each area in more detail, the primary shaft 106, which is also illustrated in FIG. 4, is mounted between the bearings 112 to allow for rotation. The primary shaft 106 includes a first gear 114 and a cable take up spool 116 and associated retaining housing 118 mounted directly to upon the primary shaft 106. Mounted upon the primary shaft 106 below the take up spool 116 is a one way clutch mechanism 120 which rotates with the primary shaft 106 only when the primary shaft rotates in one given direction. A brake disk 122 and a second gear 124 are mounted to one another and to the one way clutch 120 by a series of bolts 126 or the like. A brake caliper 128 is mounted to the frame of the device in a position to allow for braking of the brake disk 122.

Figure 5A:
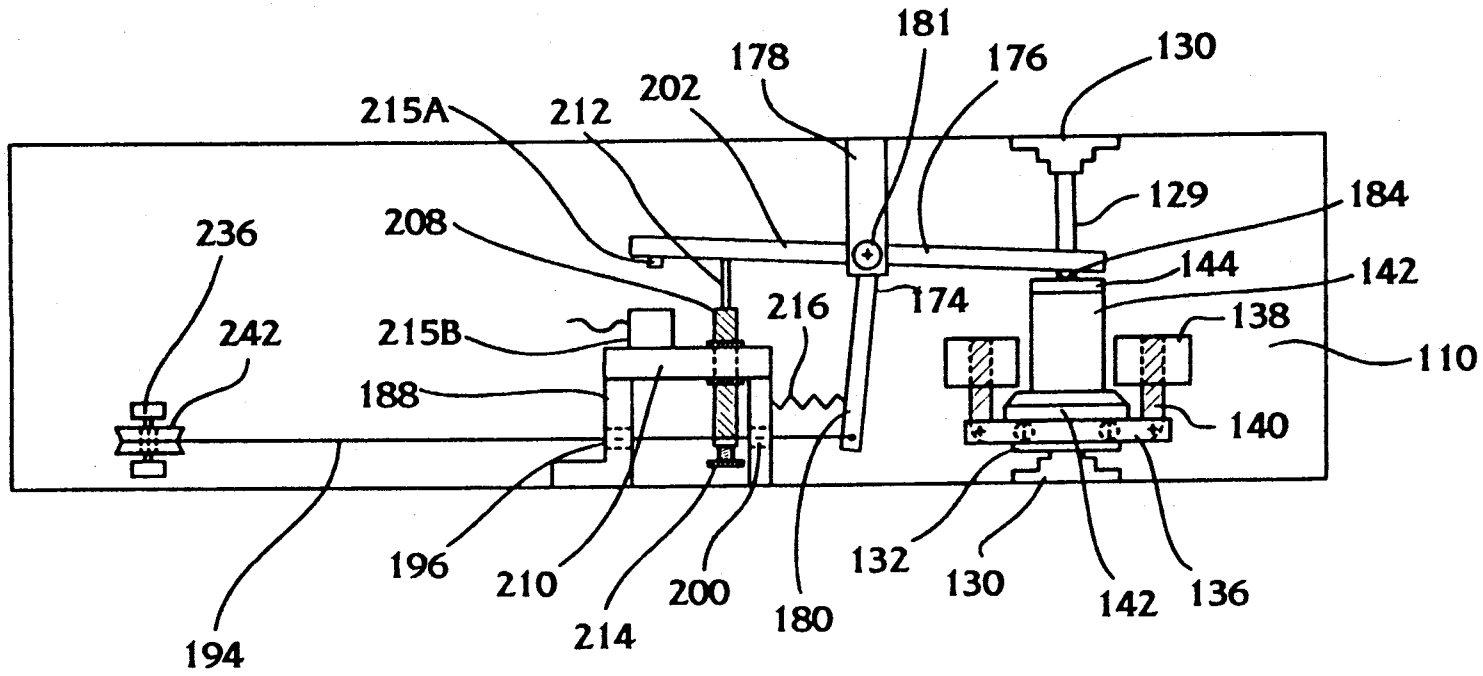
FIGS. 5*a* and 5*b* are side views of the a portion of the braking mechanism of one embodiment of the present invention.

The second shaft 129, which is better illustrated with reference to FIG. 5*a*, is also provided with bearings 130 to allow for rotation. Located above the bottom bearing 130 is a drive gear 132 which is preferably toothed and which is coupled to the gear 124 of the primary shaft 106 via a belt 134 which also preferably includes a corresponding toothed configuration. The governor 110 is mounted on the shaft 129 above the drive gear 132, and includes a base 136. Pivotally mounted upon the base are a number of L-shaped pivot arms 140 having weights 138 mounted upon one end. The weights should preferably be mounted thereon in an adjustable manner, such as by threads or the like. Above the base 136 is a cylindrical sliding thrust bushing 142 which may slide upward and downward upon the second shaft 129. Located immediately above the sliding thrust bearing 142 is preferably a cylindrical rotatable thrust bearing 144 which encircles the second shaft 129 but is not mounted upon it.

Figure 6:
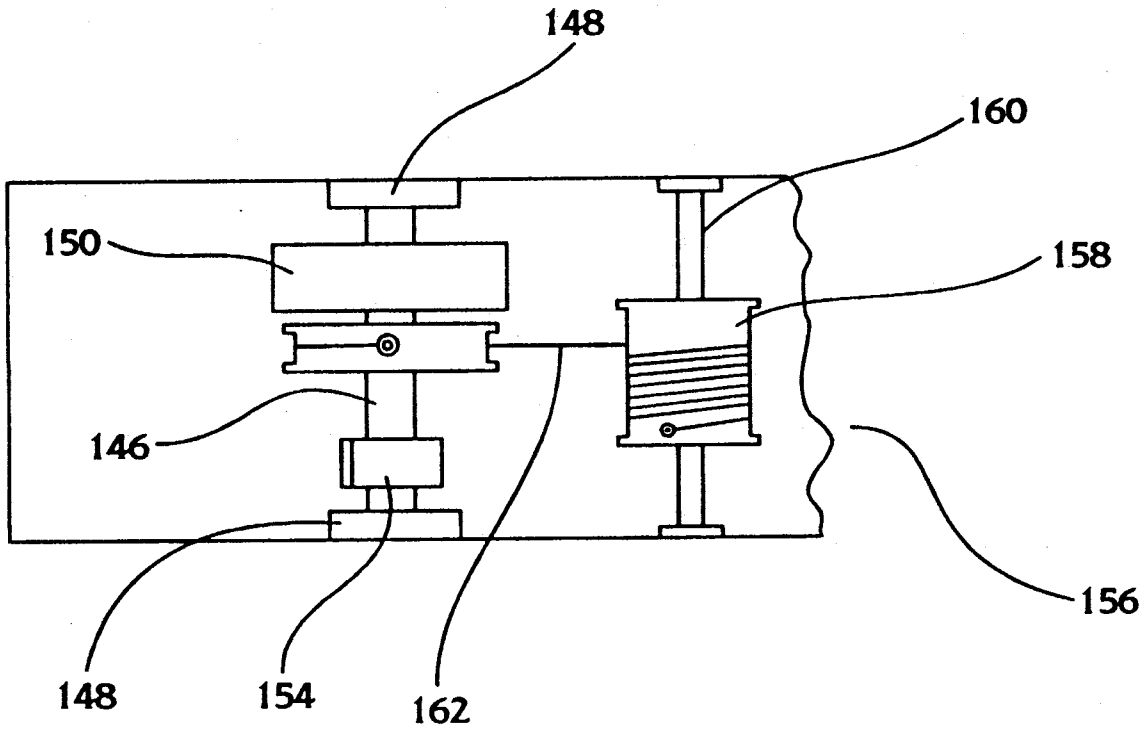
FIG. 6 is a side view of a shaft and recoil mechanism of one embodiment of the present invention.

The third area 104, the cable recoil area, is best illustrated with reference to FIGS. 3 and 6. The third area 104 includes a shaft 146 which is mounted between bearings 148 to allow for rotation. Mounted upon the shaft 146 is a drive gear 150 which is preferably toothed and which is coupled to the gear 114 of the primary shaft via a belt 152 which also preferably includes a corresponding toothed configuration. Preferably mounted below the drive gear 150 is a drive cam 154, the specifics of which will be described further below.

As illustrated in FIG. 3, tension is maintained in the belts 134 and 152 through the use of belt tensioners 155.

A spring or other recoil mechanism 156 is also provided to recoil the shaft 146 to its original position after rotation. In the embodiment illustrated, this recoil mechanism 156 includes a spring loaded reel 158 mounted on a fixed (nonrotatable) shaft 160 of square cross section located in proximity to the shaft 146. A cable or line 162 is wrapped about the reel 158, having one end fixed thereto. The opposite end of the cable or line 162 is mounted upon the shaft 146. A spring mechanism located within the reel serves to recoil the reel to its original position with respect to the fixed shaft 160 when the cable or line 162 is extended. An example of such spring loaded reel is part number MR328D manufactured by John Evans Sons, Inc. of Landsdale, Pennsylvania. Of course, any number of a variety of other spring actuated return mechanisms could be substituted for the reel 158 illustrated, depending upon a number of factors such as space utilized or manufacturing cost. For example, a clock spring mounted directly about the shaft 146 could be utilized, eliminating the need for providing an additional shaft 160, as required by the reel mechanism. With one end connected to the shaft and the opposite end connected to a fixed point such as a frame member 79, the clock spring winds tightly about itself upon rotation of the shaft, providing the necessary spring force to recoil the shaft 146.

Figure 5B:
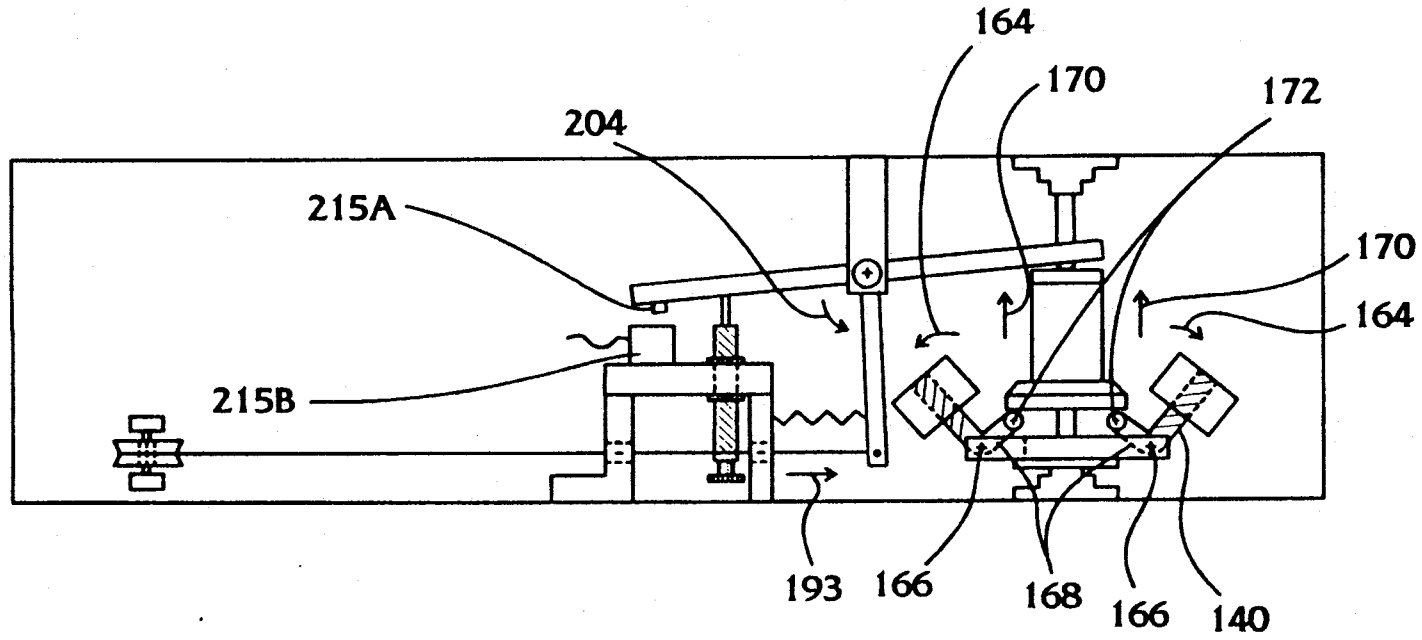

Operation of the governor 110 to produce an output signal to the brake caliper 128 will now be described. Referring to FIGS. 3, 5*a* and 5*b*, shaft 129 and governor 110 are initially stationary, with the weight of the thrust bushing 142 supported upon the lower portion of the L-shaped arms 140 of the governor 110. As the rotation of the primary shaft 106 is transferred to the drive gear 132 of the shaft 129 by the belt 134, the governor 110 begins to rotate. Rotation of the shaft 129 develops centrifugal forces at the governor 110 which act radially upon the weights 138, as shown by the arrows 164, biasing the L-shaped arms 140 to pivot about pivot points 166. The lower portion 168 of the L-shaped arms 140 lift the thrust bushing 142 vertically as shown by arrows 170, sliding along the bottom surface of the thrust bushing with wheels 172 Because the amount of centrifugal force generated is a function of the speed of rotation, the amount of vertical displacement of the thrust bushing 142 is also a function of the speed of rotation. As the thrust bushing 142 rises, it biases the bearing 144 into contact with one end 176 of the horizontal member 175 of a T-shaped force transfer arm 174.

Figure 7:
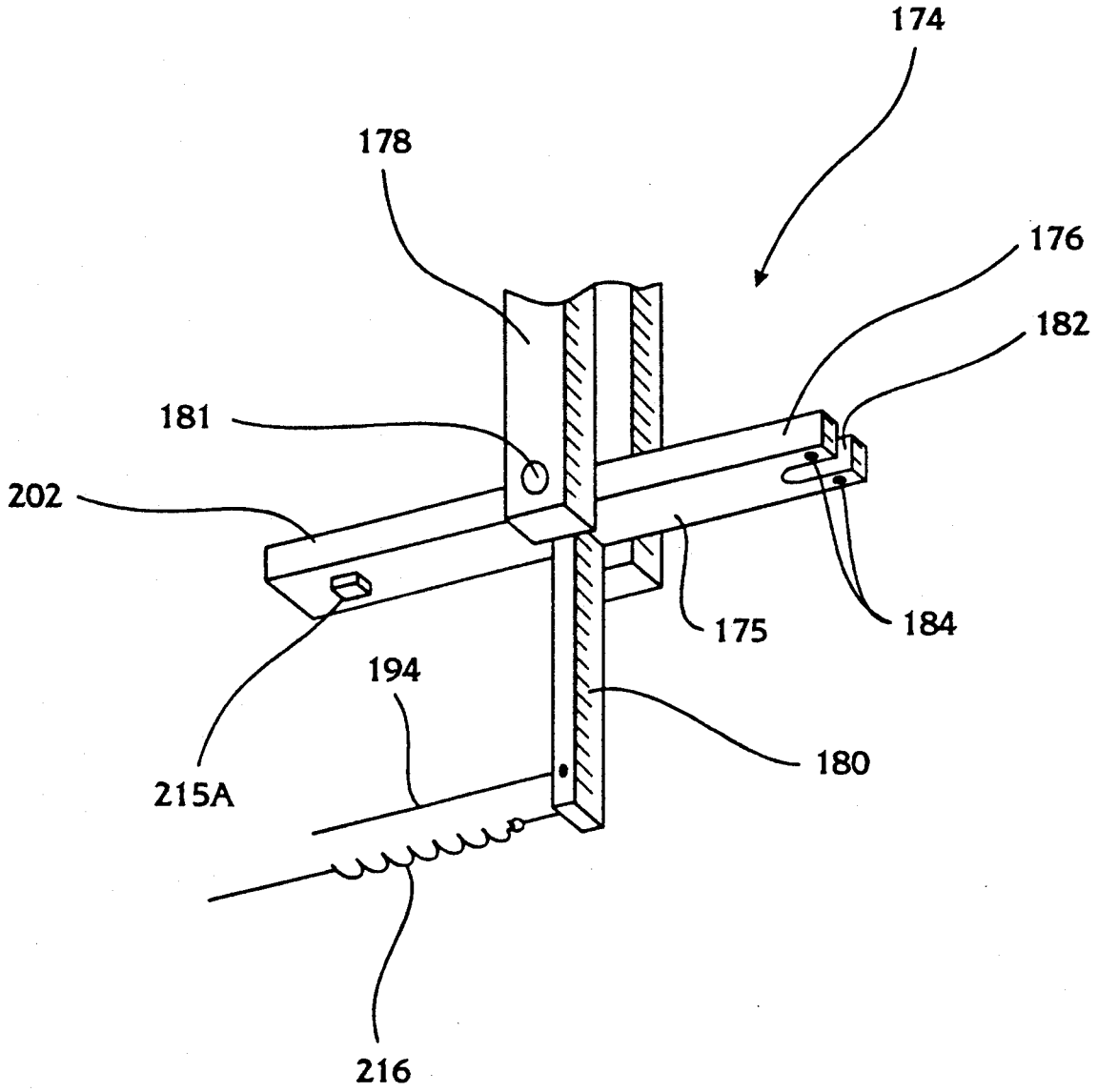
FIG. 7 is a bottom perspective view of the force transfer arm of one embodiment of the present invention.
Figure 8:
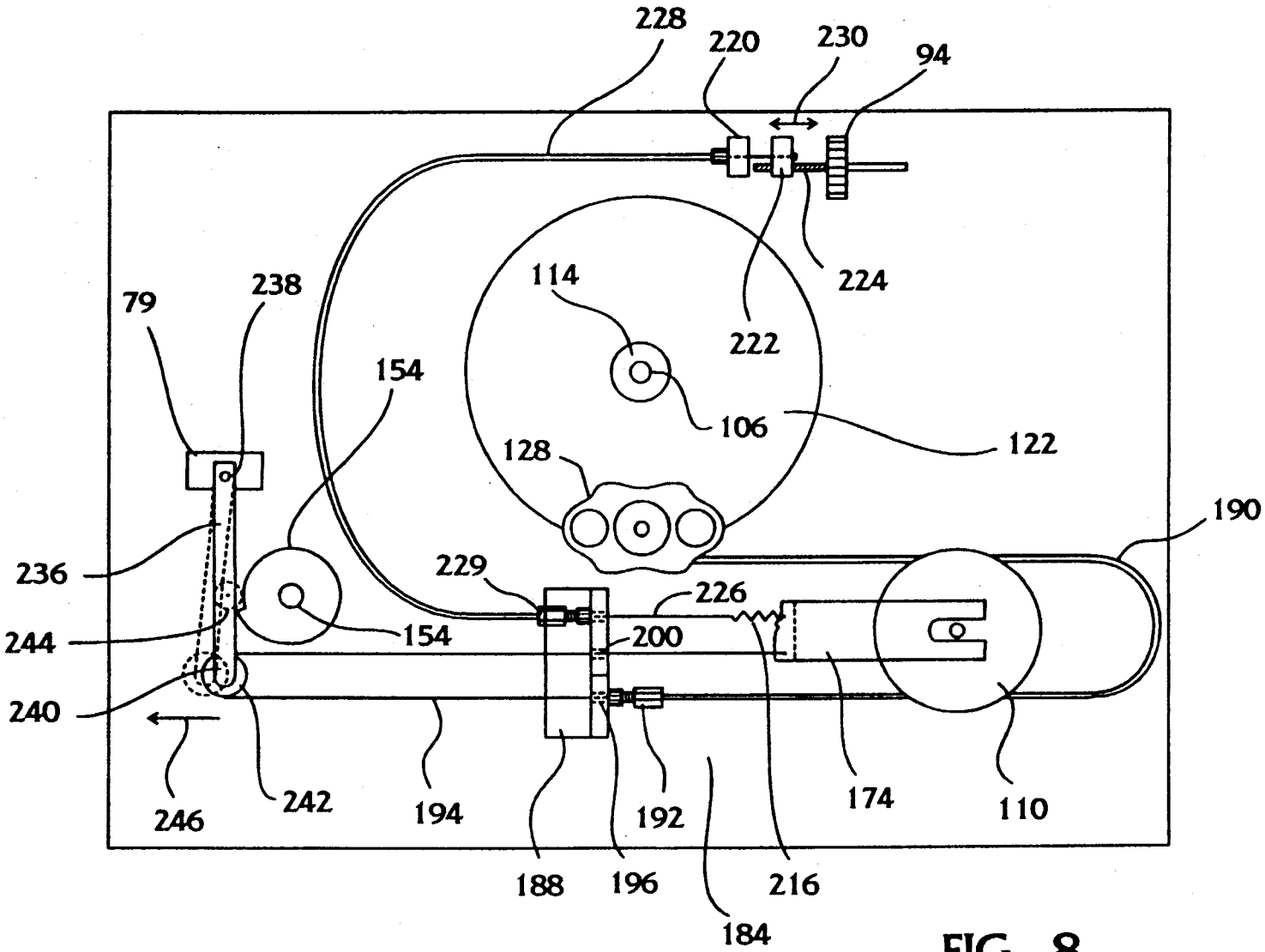
FIG. 8 is a top view of the braking mechanism and the resistance adjustment mechanism of one embodiment of the present invention.

The force transfer arm 174, also illustrated in FIG. 7 and in a cutaway view in FIG. 8, is suspended from a frame member 178 and is pivoted at the juncture of its substantially vertical member 180 and substantially horizontal member 175 at point 181. The end 176 of the horizontal member 175 includes a slot 182 designed to allow for its placement about the shaft 129. The lower surface of the end of the horizontal member 176 is also provided with a button 184 or the like made of a wear resistant and non skid material for contacting the bearing 144. As such, when the thrust bushing 142 rises and the bearing 144 comes into contact with the force transfer arm 174, the bearing 144 will stop rotating as the thrust bearing 144 and shaft 129 continue to rotate.

As is best illustrated in FIGS. 8 and 7, a sheathed brake actuation cable 184 for the brake caliper 128 extends to the mounting assembly 188 at which the sheath 190 is adjustably mounted with a conventional threaded nut assembly 192. The unsheathed cable 194 passes through an aperture 196 in the mounting assembly 188, about a wheel 242 (which will be described further below), back through another aperture 200 in the mounting assembly 188 and is fixedly connected, preferably by a set screw type arrangement, to the lower end of the vertical portion 180 of the force transfer arm 174 (note that most of the horizontal end 202 of the force transfer arm has been deleted in FIG. 8). As a result, when the force transfer arm 174 rotates about its pivot point 181 in the direction of the arrow 204 as the governor 110 rotates and the thrust bearing rises 144 (see FIG. 5*b*), the vertical portion 180 of the force transfer arm shaft moves horizontally as indicated by the arrow 193. The brake cable 194 is therefore tensioned within its sheath 190, actuating the brake caliper 128 to provide resistance to the rotation of the brake disk 122 and the primary shaft 106.

As can be noted with reference to FIGS. 5*a* and 5*b*, a shock absorber 208 is mounted upon a mounting plate 210 below the end of the horizontal portion 202 of the force transfer arm. The plunger/piston rod 212 of the shock absorber 208 serves to dampen the rotational movement of the force transfer arm 175 upon actuation by the governor 110. The shock absorber 208 preferably also includes and adjustment knot 214 to allow for variance in the amount of dampening.

As best illustrated with respect to FIGS. 1, 3, 5*a* and 5*b*, the exercise device of the present invention also provides a display 213 for showing the user the force exerted during the exercise. The display should preferably be positioned on the top panel 62 at a location near the front panel 64 where it can easily be viewed by the user. Any of a number of mechanisms may be used to measure the force exerted. In the preferred embodiment, force is measured by determining the distance of rotation of the force transfer arm during extension. One manner of determining this rotation is to measure the linear distance travelled by a given point of the force transfer arm. One such mechanism for doing do is a Hall effect sensor, which generates an output value proportional to its proximity to a magnetic source. By placing a magnetic source 215*a* on the side or lower portion of the end of the force transfer arm 175 and a Hall effect sensor 215*b* on the mounting plate 210, the sensor 215*b* will output a value which may be adjusted and calibrated in any conventional manner to provide a measure of the exerted force. In the preferred embodiment, the display should have two readouts, one of which displays the force exerted during the most recent extension, and the other of which displays the highest force exerted during the current set of repetitions, which value should be stored in a memory.

As can be appreciated by the foregoing description, extension of the cables by the user produces a resistance force which varies according to the speed of extension. In addition to being advantageous for muscular development, this resistant force is beneficial from a safety standpoint. If the user stops at any point during the extension, the resistant force immediately drops to the recoil of the device, reducing the likelihood of injury.

The present invention also includes a mechanism to vary the functional relationship between the speed of cable extension and the resultant resistance force. That mechanism is best illustrated in FIGS. 7 and 8, and includes an adjustable tension spring 216 connected at one end to the vertical portion 180 of the force transfer arm 175. The spring 216, which inhibits rotation of the force transfer arm 175 during actuation of the governor 110, tends to lessen the amount of tension imparted to the brake cable 184 as the shaft 129 rotates. The remainder of the adjustment mechanism preferably includes the adjustment wheel 94, a first adjustment block 220 mounted upon a frame member 79, panel, or any other fixed member, a corresponding second adjustment block 222 which travels along the threaded shaft 224 of the adjustment wheel 94, and a sheathed cable 226. The cable 226 extends from the opposite end of the spring 216, through an aperture 217 in the mounting plate 188 and to the second adjustment block 222 to which it is fixedly attached. The sheathing 228 extends between the first adjustment block 220 and the mounting assembly 188 to which it is attached by a conventional threaded nut assembly 229.

To vary the speed/resistance function, the user rotates the adjustment wheel 94 with the foot, moving the second adjustment block 222 in the desired direction, as indicated by the arrows 230. As the second adjustment block 222 moves closer to the first adjustment block 220, the tension of the cable 226 decreases, reducing the force imparted on the force transfer arm 174 by the spring 216. The force transfer arm is therefore more influenced by the forces imparted by the governor 110 and the thrust bushing 142, and braking effort is therefore correspondingly higher for each speed of cable extension. Conversely, rotation of the resistance adjustment wheel 94 such that the second adjustment block 222 moves away from the first adjustment block 220 allows increased spring tension to counteract the force imparted upon the force transfer arm 174 by the governor 110 and thrust bearing 142. The braking effort imparted by the governor 110 and thrust bearing 144 to the force transfer arm 175 is therefore reduced, providing a reduced amount of resistance at each speed of cable extension.

Figure 9:
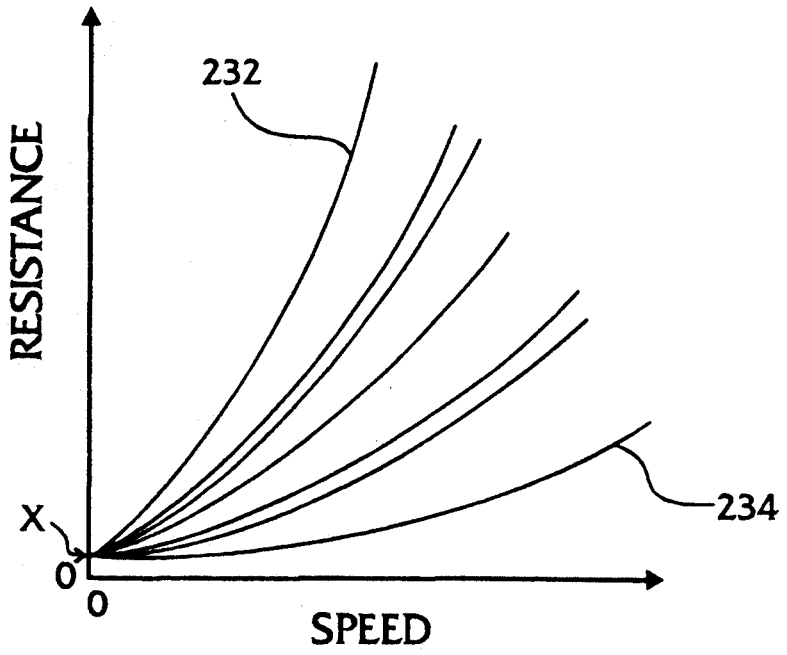
FIG. 9 is a graph illustrating the speed:resistant force relationship of one embodiment of the present invention.

FIG. 9 illustrates the functional relationship between the speed of cable extension and the resulting resistant force generated by the invention. Each of the curves represents a different setting of the resistance adjustment mechanism. The leftmost curve 232 represents the speed:resistance relationship that is encountered when the spring 216 is untensioned. At the opposite extreme, the rightmost curve 234 represents the situation in which the spring 216 is at the maximum tension, reducing the amount of resistance provided for each speed of cable extension. As can be appreciated, the user may select from an infinite number of speed:resistance settings between these two extremes to suit individual exercise needs and desires.

FIG. 9 also illustrates an important advantage of the utilization of the one way clutch 120 illustrated in FIG. 3. As previously described, the extension cables 90 of the present are recoiled upon the take up spool 116 as the spring mechanism 156 recoils the shaft 146 after each exercise cycle. Because this recoil force is constantly applied to the primary shaft 106, the recoil force must be overcome in order for the cables 90 to be extended during exercise. From an operation standpoint, as well as component specification and related cost standpoint, it is therefore advantageous to design the invention to require a recoil force that is as small as possible. For example, if a recoil force of 100 pounds was required to recoil the cables 90, the user would be required to exert 100 pound of force before the cables could be extended. This minimum force would be required to begin cable extension for any selected speed:resistance relationship setting. As can be appreciated, a high recoil force also defeats the ideal objective of providing a resistant force that is a function of speed of extension for all speeds, because, in effect, the objective goal is not accomplished for resistant forces less that the recoil force.

In the present invention, the one way clutch 120 mounted on the primary shaft 106 minimizes the recoil force by requiring rotation only of the primary shaft 106, the drive gear 114 t o the shaft 146 and the take up spool 116. The brake disk 122 and the drive gear 124 for actuation of the shaft 129 are mounted upon the one way clutch 120, and thus they remain stationary upon recoil of the cables. Their moments of inertia need not be overcome during recoil of the cables 90, as would be the case if the one way clutch 120 was not utilized.

The present invention also provides a mechanism to reduce the likelihood of hyperextension of joints. Of course, in the context of the described embodiment of the present invention, the relevant joint is the knee joint. It should be appreciated, however, that the mechanism hereinafter described is equally applicable to other joints being extended during use of other embodiments of the present invention.

As is best illustrated with reference to FIGS. 3 and 8, the mechanism to reduce the likelihood of hyperextension includes an arm 236 which is pivotally mounted to the frame 79 of the housing at a first end 238. Located at the opposite end 240 of the arm 236 is a wheel 242 about which an unsheathed portion 194 of the brake cable passes. The normal tension of the brake cable 194 biases a contact bearing 244 located along the length of the arm 236 into contact with the cam 154 which is mounted upon the shaft 146. The cam 154 is selected so as to have a generally uniform radius of curvature about most of its circumference, but with a dramatically increasing radius of curvature in one area. The cam 154 is mounted upon the shaft 146 such that the area of increasing radius of curvature comes into contact with the contact bearing 244 when the cables 90 are almost fully extended and the knees of the user are almost fully extended. When the area of increase radius of curvature comes into contact with the contact bearing 244, the contact bearing and the remainder of the arm 236 are biased in the direction of the arrow 246, with the wheel 242 dramatically increasing the tension of the brake cable 194. As a result, the brake caliper 128 prevents further rotation of the brake disk 122. Further extension of the cables 90 by the user is prevented, reducing the likelihood of full extension or hyperextension of the user's knees.

FIG. 3 also illustrates the mechanism for adjusting the width of the cables 90 to accommodate users of different sizes. The mechanism includes a guide shaft 248 which extends across the housing below the top panel 62 and which is mounted to appropriate frame members 79. Two guide blocks 250 are slidingly mounted upon the guide shaft 248 in the vicinity of the slots 92 and have pulleys 252 pivotally attached thereto. The cables 90 pass about the pulleys 252, extend vertically through sleeves 253 and pass out of the slots 92. A shaft 254 rotating about bearings 255 also passes through an aperture (not shown) in each of the guide blocks 250. The rotatable shaft 254 is threaded in a first direction along the vicinity of one of the guide blocks and in an opposite direction along the vicinity of the other guide block. The guide blocks 250 also include threads on the inside of their apertures corresponding to the shaft threads passing therethrough. A foot wheel 96 partially extending above the top panel 62 can be used to actuate rotation of the threaded shaft in a either direction through a belt and gear arrangement 257, a plurality of interacting gears, or the like. When the foot wheel 96 is rotated in a first direction, the guide blocks 250 and the cable pulleys 252 move along the threaded shaft 254 and guide shaft 248 towards one another. Conversely, when the foot wheel 96 is turned in the opposite direction, the guide blocks 250 and the cable pulleys 252 move along the threaded shaft 254 and guide shaft 248 away from one another.

As a modification to the above described embodiment, it is realized that the function of the different shafts described above may be combined for additional space and possibly cost savings. For example, a recoil mechanism and/or a cam and/or a resistance generating mechanism may be mounted directly upon the primary shaft. Alternatively, if multiple shafts are used, it is realized that the specific locations described are for illustrative purposes only and may be selected at any location without detracting from the scope of the invention. Moreover, the mechanics by which the second and third shafts, or other shafts used in other embodiments, need not be by the mechanisms illustrated and described. For example, chains may be used instead of toothed gears.

Figure 10:
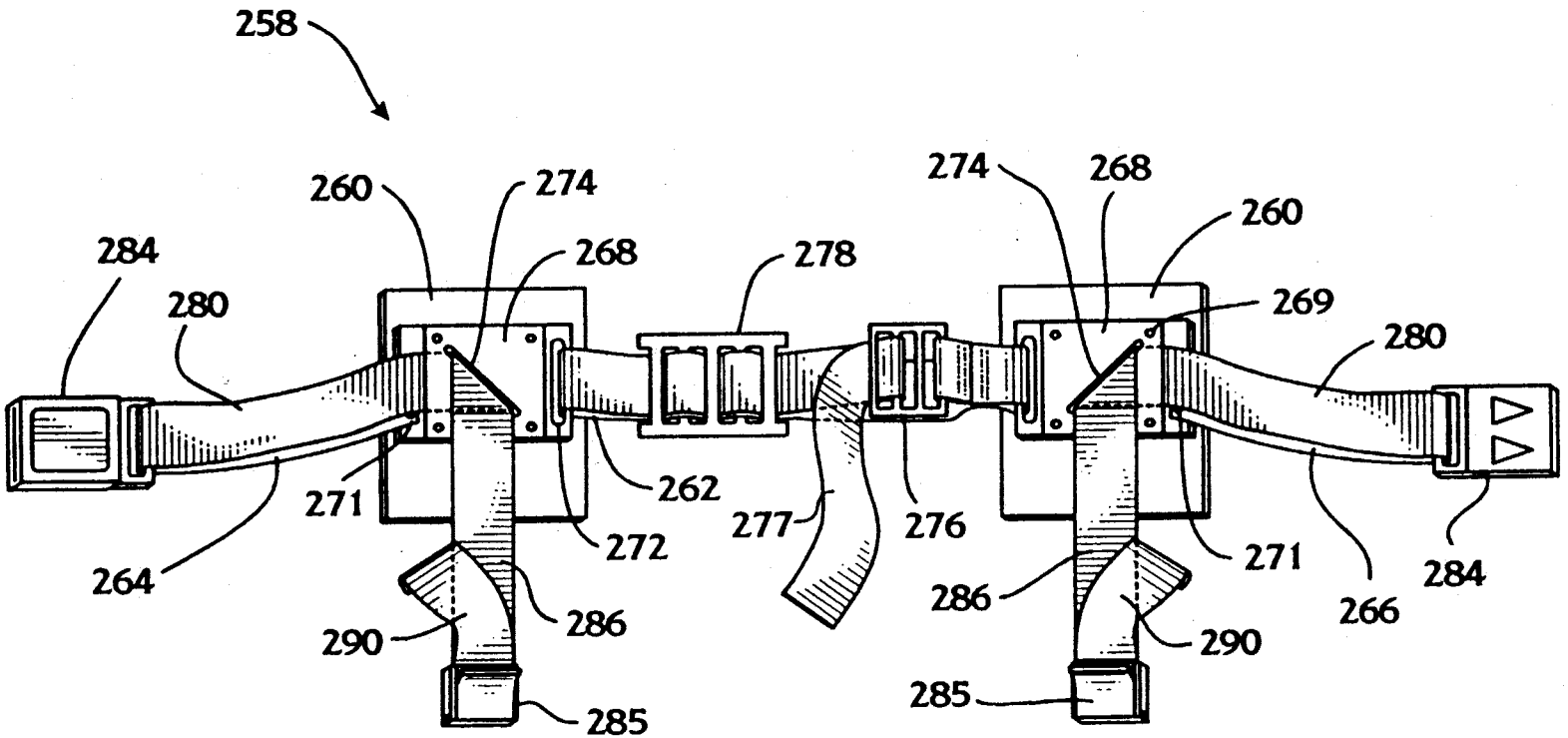
FIG. 10 is a back view of one embodiment of a belt apparatus used in conjunction with one embodiment of the exercise device of the present invention.

The exercise device of the present invention is designed to be used in conjunction with the belt apparatus 258 illustrated in FIG. 10. This belt apparatus will be recognized as an embodiment of an invention which is the subject of the concurrently filed application to Moschetti, et al. The belt apparatus includes two main pads 260 to be supported about the hips of the user, a first belt length 262 belt for securing the pads 260 together at the rear of the user, and a second 264 and third belt lengths 266 for securing the pads together at the front of the user, as well as for serving as means for attaching the cables 90 of the invention to the user. Each pad 260 includes a layer of conventional foam and plate of high density plastic plate made of HDPE or UHMW or the like, with a cover material such as cordura covering both layers. A unitary piece of hardware 268, preferably made of DELRIN (tradename for a type of acetyl polymer) or other similar type of polymer is secured to the outside of each pad 260 by means of bolthead screws 269 or the like which extend through to the high density plastic plate. The hardware, as illustrated, should preferably be formed with a vertical slot 272 through which the back length of the belt may pass, as well as an angled slot 274 through which the second 264 or third length 266 may pass.

The belt lengths are preferably formed of nylon webbing such as that found in aircraft seat belts, and should have characteristics sufficient to support the loads commonly associated with leg exercises. The first belt length 262 at the rear of the belt apparatus extends through the vertical slots 272 of the pad hardware, with one end of the length secured, preferably by sewing, as indicated, to a buckle 276 through which the opposite end passes. The buckle should preferably be of an adjustable variety such as that illustrated, wherein the length of the end 277 passing therethrough may be adjusted to lengthen or shorten the effective size of the belt apparatus to accommodate for different sized users. A guide 278 made of plastic or the like may also be provided along the first length 262 to retain the doubled over portions in close proximity.

The second 264 and third 266 belt portions loop 280 back to the belt hardware 268 where they pass through the angled slots 274 and extend downward. The ends 271 of the lengths should be firmly attached to the pad hardware 268, preferably by means of bolthead screws which pass through to the high density plastic plate within the cover of the pad. Interacting adjustable position male and female buckles 284 are respectively provided along the along the front loops 280 to enable engagement by users of different sizes. Buckles portions 285 are also provided along the downward extending portions 286 of the belt lengths to allow for engagement with corresponding buckle portions 288 secured to the ends of the cables, as illustrated in FIG. 1. The buckle portions 285 should also be of the variety that can be adjusted along the length of the downward extending portions 286, preferably by pulling the end portion 290.

The belt apparatus, when used in conjunction with the embodiment described above, vastly reduces the likelihood of injury to the user's back. The force bearing load is supported entirely by the hips rather than the vertebrae. Moreover, and unlike free weights and some elastic and cam based systems, the arms and remainder of the upper body are free to move in a normal manner, enabling sport specific training. For example, if the described embodiment is used to simulate jumping, the arms are free to be swung along the sides and extended above the head of the user.

Because the belt apparatus can be disengaged from the cables, the user is free to secure the belt apparatus without necessarily being in position for performing the exercise.

In operation, the user positions the pads 260 about his hips and adjusts the lengths of the front loops 280 and the length of the first belt length 262 so that the pads 260 are secured firmly in position. The downward extending portions 286 of the second 264 and third 266 lengths should then be tensioned through the angled slots 274 to remove any slack in the front loops 280. The user then stands in position on the top panel 62 of the exercise device and the engages the buckle portions 288 attached to the ends of the cables with the corresponding buckle parts 285 of the belt 258. Thereafter, while standing erect with heels flat on the top panel, the user pulls on the ends 290 of the webbing, adjusting the length of the downward extending portions 286 and extending the cables 90. Pulling should continue until the cam prevents further extension of the cables and the cables are evenly taut. The user is then in position to commence exercise repetitions. When the user is finished, the buckles 284 should be released, allowing the user to remove the belt apparatus 258 in a location remote from the exercise device.

I claim:

1. An exercise device, comprising:

a housing;

at least one extendable cable passing within said housing;

cable retraction means for retracting the at least one cable within the housing with a cable retraction resistance force of predetermined value;

additional resistance means for providing an additional resistance force opposing extraction of the cable such that the additional resistance force is a function of the speed of cable extension; and adjustment means for varying the functional relationship between the speed of cable extension and the additional resistance force resulting from the speed of cable extension.

2. An exercise device according to claim 1, wherein the additional resistance means includes:

a rotatable shaft mounted within the housing to which at least one end of the at least one cable is fixed, and a braking mechanism for reducing the rotational velocity of the shaft.

3. An exercise device according to claim 2, wherein the braking mechanism includes:

a brake disk mounted upon the shaft and a brake caliper mounted within the housing which acts upon the brake disk.

4. An exercise device according to claim 1, wherein the additional resistance means includes:

a rotatable shaft mounted within the housing about which the at least one cable extends;

output generating means within the housing for generating an output signal proportional to the rotational velocity of the shaft;

braking means for imparting a braking force rotation of the shaft which is proportional to the output signal of the output generating means.

5. An exercise device according to claim 4, wherein the adjustment means includes means for varying the magnitude of the output signal.

6. An exercise device according to claim 1, further comprising means for dramatically increasing the resistant force when the at least one cable is near full extension.

7. An exercise device, comprising:

a housing;

a rotatable shaft mounted within the housing;

at least one extendable cable passing within said housing and fixed at one end to the shaft;

a spring operatively connected between the housing and the shaft for retracting the at least one cable about the shaft;

a governor operatively connected to the rotatable shaft, wherein the governor produces a displacement which is proportional to the rotational velocity of the shaft;

a brake located in proximity to the shaft for resisting the rotation of the shaft based upon the magnitude of a brake signal;

brake signal generating means operatively connected to the governor for generating the brake signal applied to the brake such that the magnitude of the brake signal is proportional to the magnitude of the governor displacement; and adjustment means operatively connected to the brake signal generating means for varying the proportional relationship between the magnitude of the governor displacement and the magnitude of the brake signal generated.

8. An exercise device according to claim 7, wherein the brake signal generating means includes a rotational member mounted in proximity to and in operational contact with the governor such that the rotational member rotates when the governor produces a displacement; and a brake cable extending between the rotational member and the brake, and such that the brake cable is tensioned when the rotational member rotates during governor displacement.

9. An exercise device according to claim 8, wherein the adjustment means comprises a variable tension spring connected to the rotational member in a manner to oppose movement of the rotational member during governor displacement.

10. An exercise device according to claim 9, further comprising an adjustment mechanism mounted on the housing for varying the tension of the variable tension spring.

11. An exercise device according to claim 7, further comprising:

means for dramatically increasing the resistant force when the at least one cable is near full extension.

12. An exercise device according to claim 8, further comprising:

means for dramatically increasing the resistant force when the at least one cable is near full extension.

13. An exercise device according to claim 12, wherein:

said means for dramatically increasing the resistant force comprises means for substantially increasing the tension of the brake cable when the shaft is near full extension.

14. An exercise device according to claim 4, further comprising dampening means operatively connected to the output generating means for dampening fluctuations in the output signal.

15. An exercise device according to claim 7, further comprising dampening means operatively connected to the governor for dampening fluctuations in the governor displacement.

16. An exercise device according to claim 1, wherein the additional resistance force is zero at speed zero for all settings of the adjustment means.

17. An exercise device according to claim 7, wherein the magnitude of the brake signal is zero when the magnitude of the governor displacement is zero for all settings of the adjustment means.

18. An exercise device, comprising:

a rotatable shaft;

at least one cable fixed at one end to the rotatable shaft;

means for retracting the at least one cable about the shaft;

a brake assembly located in proximity to the rotatable shaft for braking the rotary movement of shaft during extension of the cable with a braking force that varies as a function of the speed of shaft rotation; and adjustment means operatively connected to the brake assembly for varying the functional relationship between the speed of shaft rotation and the magnitude of the braking force imparted by the brake assembly.

19. An exercise device according to claim 18, wherein the braking force is zero at speed zero for all settings of the adjustment means.

20. An exercise device according to claim 18, further comprising a damper for dampening the braking force applied to the shaft.

* * * * *